US008341986B2

(12) United States Patent
Sakai et al.

(10) Patent No.: US 8,341,986 B2
(45) Date of Patent: Jan. 1, 2013

(54) KEY BOX CONSTRUCTION

(75) Inventors: Nobuyo Sakai, Toshima-ku (JP); Yoshimasa Kataumi, Kumagaya (JP)

(73) Assignee: Keiden Security Kikihanbai Kabushiki Kaisha, Tokyo (JP)

( * ) Notice: Subject to any disclaimer, the term of this patent is extended or adjusted under 35 U.S.C. 154(b) by 191 days.

(21) Appl. No.: 12/816,786

(22) Filed: Jun. 16, 2010

(65) Prior Publication Data

US 2011/0079056 A1 Apr. 7, 2011

(30) Foreign Application Priority Data

Oct. 7, 2009 (JP) ..... 2009-233229

(51) Int. Cl.
*E05B 65/52* (2006.01)

(52) U.S. Cl. ..... 70/63; 70/25; 70/26; 70/38 A; 70/52; 70/162; 70/173; 70/456 R

(58) Field of Classification Search ..... 70/456 R, 70/459, 38 A, 63, 24–26, 52, 158–163, 166–173; 109/69–73; 206/1.5, 37, 37.1, 37.4, 37.8, 206/38.1

See application file for complete search history.

(56) References Cited

U.S. PATENT DOCUMENTS

| | | | | | |
|---|---|---|---|---|---|
| 1,891,961 | A * | 12/1932 | Taylor | 70/169 |
| 2,911,814 | A * | 11/1959 | Williams | 70/14 |
| 3,224,480 | A * | 12/1965 | Burman, Jr. | 206/37.7 |
| 4,331,168 | A * | 5/1982 | Hatakeyama | 132/316 |
| 5,427,265 | A * | 6/1995 | Cautereels et al. | 220/318 |
| 5,823,022 | A * | 10/1998 | Barker | 70/38 A |
| 5,857,738 | A * | 1/1999 | Hamilton | 296/57.1 |
| 6,793,074 | B2 * | 9/2004 | Anderson et al. | 206/349 |
| 6,834,519 | B1 * | 12/2004 | Yang | 70/58 |
| 7,275,642 | B2 * | 10/2007 | Yuhara | 206/581 |
| 2004/0226325 | A1 * | 11/2004 | Ling | 70/63 |
| 2005/0247579 | A1 * | 11/2005 | Lin | 206/1.5 |
| 2006/0213237 | A1 * | 9/2006 | Yang | 70/63 |
| 2009/0090145 | A1 * | 4/2009 | Engelberth | 70/159 |
| 2009/0095036 | A1 * | 4/2009 | Ng et al. | 70/63 |
| 2009/0151402 | A1 * | 6/2009 | Lee | 70/25 |
| 2009/0320534 | A1 * | 12/2009 | Lee et al. | 70/158 |

FOREIGN PATENT DOCUMENTS

| | | | |
|---|---|---|---|
| EP | 0895941 | A | 2/1999 |
| GB | 2323589 | A | 9/1998 |
| GB | 2372066 | A | 8/2002 |
| JP | S56-139763 | U | 10/1961 |
| JP | S59-24856 | U | 2/1984 |
| JP | S62-71259 | U | 5/1987 |
| JP | H1-94580 | U | 6/1989 |
| JP | H4-84686 | U | 7/1992 |
| JP | H5-71255 | A | 3/1993 |
| JP | 2001-314320 | A | 11/2001 |
| JP | 2005-29973 | | 2/2005 |
| JP | 2008-014040 | A | 1/2008 |
| JP | 3146547 | U | 10/2008 |
| WO | 2007/112365 | A | 10/2007 |

* cited by examiner

*Primary Examiner* — Lloyd Gall
(74) *Attorney, Agent, or Firm* — McCarter & English, LLP

(57) ABSTRACT

A key box construction, wherein a shaft of a door is provided with two parallel flat surfaces in axial extensions of the shaft, an outer cover is provided with bearing parts which each comprise a groove having the same width between parallel flat surfaces of the groove as the width between the two parallel flat surfaces of each axial extension and at an angle. The door is provided at the lower end portion thereof with hooks, whereby the door is hooked directly on an inner case by the hooks and a latch.

8 Claims, 13 Drawing Sheets

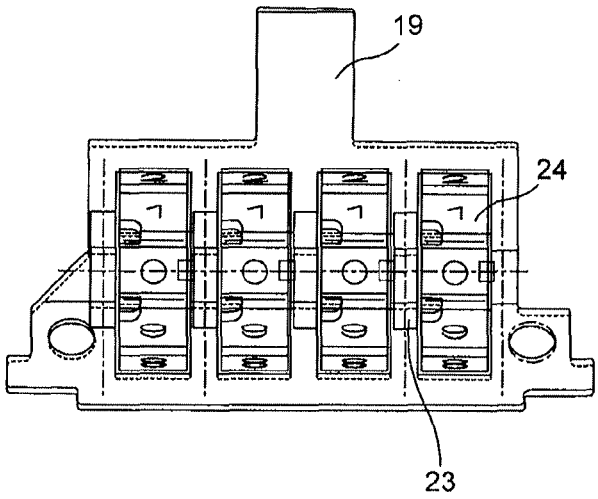
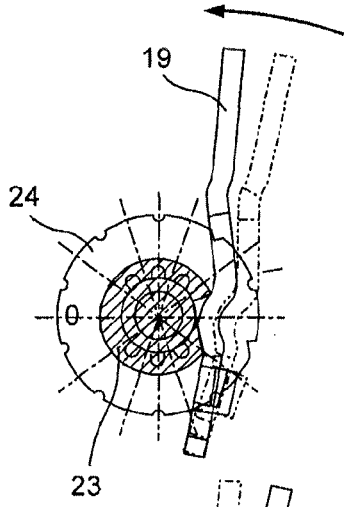
F I G. 9-3
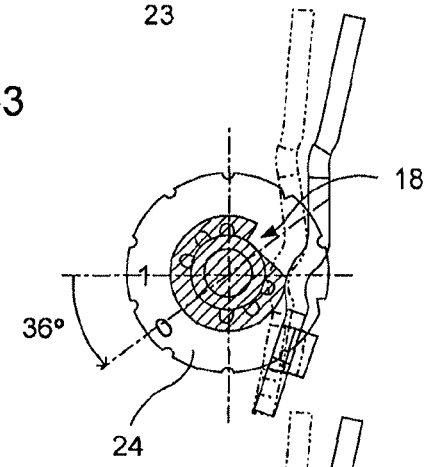
F I G. 9-4
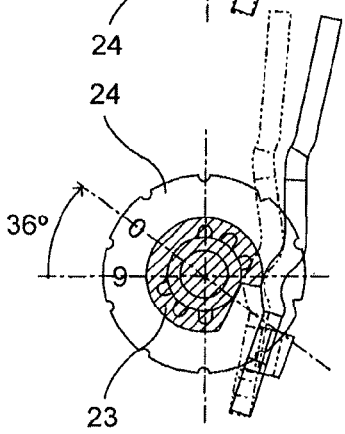
F I G. 9-5

KEY BOX CONSTRUCTION

BACKGROUND

1. Technical Field

This invention relates to a key box construction having a strength which enables any unjust cancellation to be certainly prevented.

2. Background of the Art

An existing dial type key box has a construction, in which two or more dials each having numbers 0:9 are set to determined voluntary figures (a secret code number) to rotate (open) a door. However, since the door cannot be taken away from the key box, setting of the numbers, and mounting on the wall or the like are difficult to carry out, and moreover, making the construction which allows the rotary shaft to be removed with an operator's hand, was impossible as viewed in terms of strength.

Furthermore, since a shackle was difficult to detach, and mounting the key box on the wall or the door of a building was troublesome, making it serve a double purpose of a hanging-down type and a wall-mounted type was impossible. Moreover, when ones like credit cards are stored, there were problems, one being that of such a card leaning on the inner wall so that the card is difficult to take out, and the other being a problem that the card obstructs, so that a key, a finger ring or the like are difficult to store. Moreover, external appearance, that is, an outer cover in the case of a hanging-down type, is covered with rubber or resin to prevent the object on which the key box is mounted from being damaged; however, this was one which spoils the aesthetic appearance thereof.

SUMMARY OF THE INVENTION

Problem to be Solved by the Invention

A problem of this invention is to provide a key box construction, in which a door is constructed in such a manner that, in addition to having strength, rotation and removal of the door is possible, the shackle is constructed in an easily removable manner and aims at using the key box as both a hanging-down type and a wall-mounted type, even when cards or the like are stored, they are easy to take out, and the key box is of a flexible resin construction having a colored external appearance and facilitating the mounting of the key box.

Form for Solving the Problem

This problem is solved by a key box construction, characterized in that the shafts of a door are each provided with two parallel flat surfaces in the direction of the rotary shafts, that an outer cover is provided with bearing parts which each comprise a groove having the same width at an angle which does not allow the door to be taken away at the time of usual opening and closing of the door, and that the door is provided at the lower end portion thereof with hooks, whereby the door is hooked directly on an inner case by means of the hooks and a latch.

Furthermore, according to this invention, a shackle is, in a point symmetrical manner, provided at both legs thereof with grooves in which a locking lever engages, thereby eliminating a course of action (in front and behind) when the shackle is inserted.

According to the key box construction of this invention, the key box is constructed in such a manner that a key storing tray is included in the key box. Furthermore, it is also possible to construct the key storing tray in such a manner that it has an inclination from the door side towards an operator to the interior, whereby when a card is inserted therein, it naturally falls to the door side towards the operator.

Moreover, a front outer cover is shaped in such a manner that when the door is closed, removal of the front outer cover is impossible due to the bearing parts for rotating the door, and a rear outer cover is shaped in such a manner that it is provided with holes for inserting the shackle, so that removal of the rear outer cover is impossible without detaching the shackle.

EFFECT OF THE INVENTION

According to the key box construction of this invention, an outer cover is provided with grooves each having the same width at an angle which does not allow the outer cover to be taken away at the time of usual opening and closing of the door, thereby making the door construction removable. Furthermore, provision of the hooks at the lower end portion of the door allows, even if the bearing parts are weak, regardless of this, the door, when closed, to be directly hooked on the inner case by means of the hooks and the latch, thereby increasing the breaking strength. Moreover, because of the removable door construction, even when the door or the outer cover is broken, exchange of only the broken parts is possible, and accordingly, inexpensive.

This invention allows the shackle to be attached and detached in one-touch control by eliminating a course of action in front and behind when the shackle is inserted. This facilitates the mounting on the wall, the door or the like, and in addition, the basic parts (the door, the front outer cover, the front inner case, the key storing tray, the rear inner case, and the rear cover) can be made to serve a double purpose. Moreover, since the shackle is shaped in such a manner that both legs of the shackle are locked by means of the shackle locking lever, a strength higher than that in the past can be secured.

The key storing tray is included in the key box, so that no omission of a card, a key, a finger ring or the like occurs, and the storing thereof is made easy. Furthermore, in the case where the key storing tray is constructed in such a manner that it has an inclination from the door side towards an operator to the interior at both sides thereof with a width a little narrower than the traversal width of the card, when a card is inserted therein, it naturally falls to the door side towards the operator, and in addition, the above-mentioned construction allows to aim at being easy to store a key, a finger ring or the like, and at securing the storing space to the maximum degree.

The outer covers are shaped in such a manner that they can be assembled in one-touch control, the front outer cover is shaped in such a manner that when the door is closed, removal of the front outer cover is impossible due to the bearing parts for rotating the door, and the rear outer cover is shaped in such a manner that the provision of holes for inserting the shackle makes removal of the rear outer cover impossible without detaching the shackle.

BRIEF EXPLANATION OF THE DRAWINGS

FIG. 1-2 is a side sectional view showing a state where the door of the key box is opened until a removable position;

FIG. 1-3 is a side sectional view showing a state where the door of the key box is pulled out in the arrow-marked direction;

FIG. 1-4 is a side sectional view showing a state where the door of the key box is opened to the maximum degree;

FIG. 2 comprises views each showing the upper surface; the front; and the side section of bearing parts of an outer cover;

FIG. 3 comprises views each showing the front and the side of the shaft of a door;

FIG. 4 is a view showing a process of a shackle being engaged by a locking lever;

FIG. 7-1 shows a case where a card is inserted in the key box;

FIG. 7-2 shows a case where the card is inserted in the key box; and the outer cover is opened;

FIG. 7-3 is a perspective view of a key storing tray;

FIG. 8-1 is a perspective view showing a state before the outer covers are fitted to an inner case assembly;

FIG. 8-2 is a perspective view showing a state where the outer covers are fitted to the inner case assembly;

FIG. 8-3 comprises perspective views of the front outer cover; one being a view showing the front and the other being a view showing the inside;

FIG. 9-1 is a view showing a state where the locking plate disengages from dial cam grooves;

FIG. 9-2 is a view showing a state where the locking plate engages in the dial cam grooves;

FIG. 9-3 is a view showing a reference state between the dials and the locking plate;

FIG. 9-4 is a view showing a disengaged operation state of the dial cam grooves and the locking plate;

FIG. 9-5 is a view showing a further disengaged operation state of the dial cam grooves and the locking plate;

DETAILED DESCRIPTION OF THE DISCLOSED EMBODIMENTS FORM FOR CARRYING OUT THE INVENTION

This invention will be explained in detail by way of an example with reference to the drawings.

Example 1

Figures 1, 2, 3:
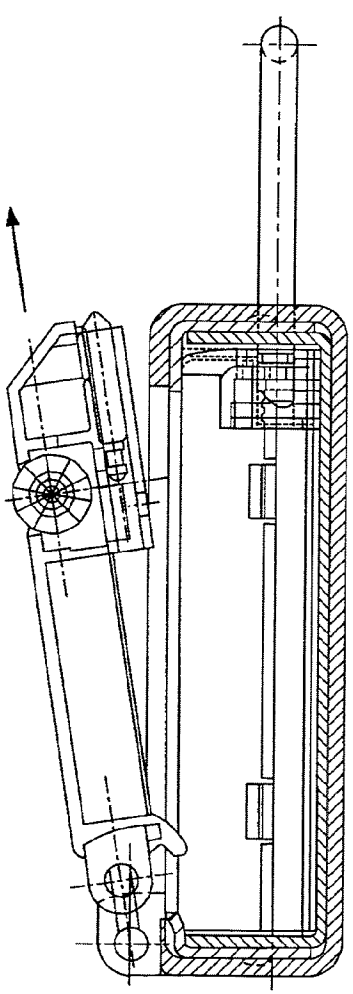
Figures 1, 2:
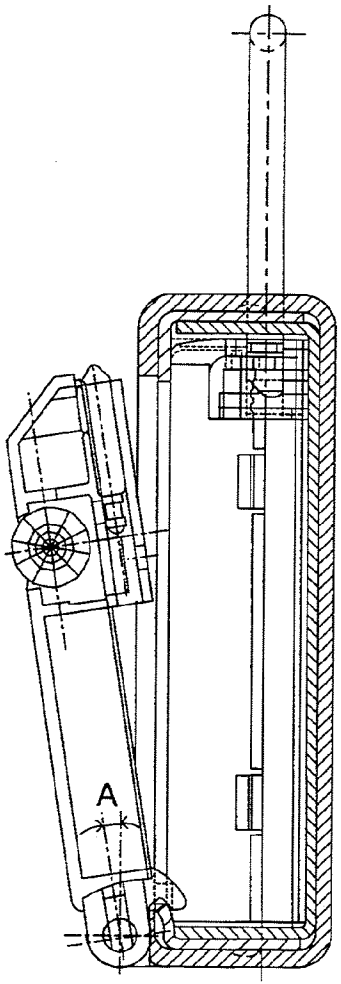
Figure 1:
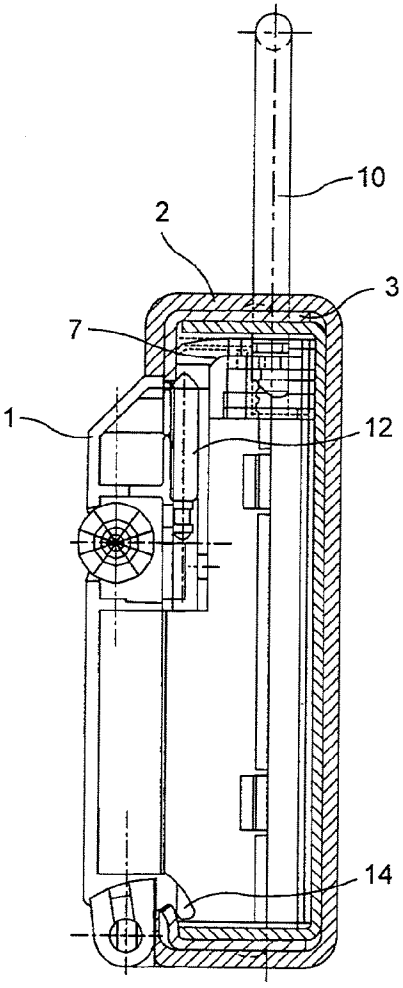
FIG. 1-1 is a side sectional view showing a state where a door of a key box is closed.

Referring to FIG. 1, a key box is illustrated from a state where a door 1 is closed (FIG. 1-1) to a state where the door is opened to a removable position (FIG. 1-2), further, by way of a state where the door is pulled out in the arrow-marked direction (FIG. 1-3), and at last until a state where the door is opened to the maximum degree (FIG. 1-4).

The shaft of the door 1 is provided with two parallel flat surfaces B in the circumferential direction of the shaft (FIG. 3) in the axial extensions of the shaft, and an outer cover 2, which at a hinging end are provided with bearing parts in the form of grooves C each having the same width as the distance between the flat surfaces (FIG. 2) and at an angle A (FIGS. 1-2), thereby enabling the door to be removed. Removal of the door 1 is made possible by providing bearing parts 20 in the outer cover 2 made of resin; however, in that degree, the bearing parts 20 are weak in breaking strength. As a solution strategy thereof, hooks 14 are provided at the lower end of the door 1 (FIGS. 1-1), whereby even if the bearing parts 20 are weak, regardless of such weakness, in a state where the door 1 is closed, the door 1 is hooked directly on an inner case 3 (made of a strength member) by means of hooks 14 and a latch 12, thereby making the breaking strength stronger. Furthermore, since the door is removably constructed, if by any chance the door 1 or the outer cover 2 is broken, response to such accident is possible by exchange of only said parts, and accordingly, is inexpensive. FIG. 3 is a view showing the front and the side of the shaft 21 of the door.

Figures 1, 2, 3, 4:
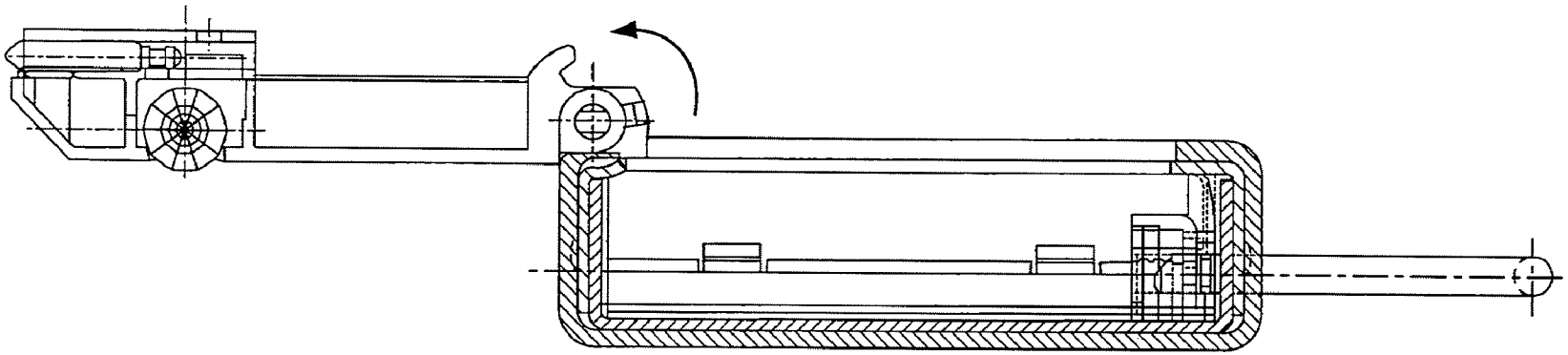
Figure 2:
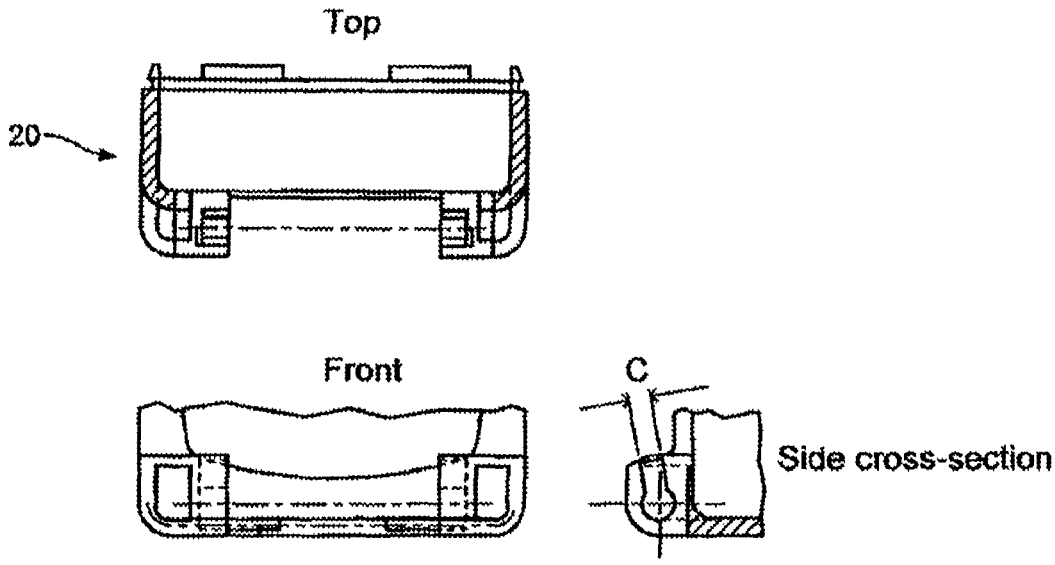
Figure 3:
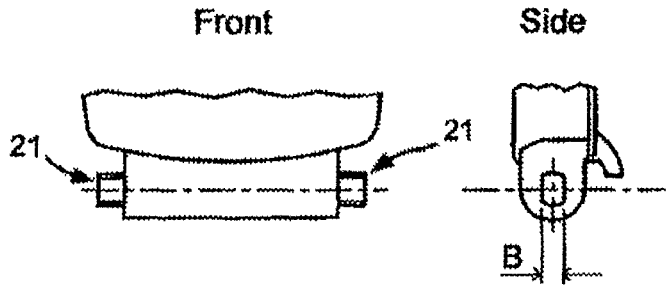
Figure 4:
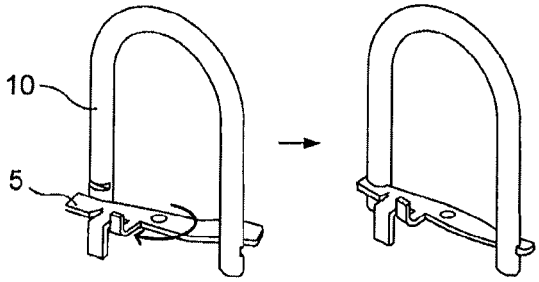
Figure 5:
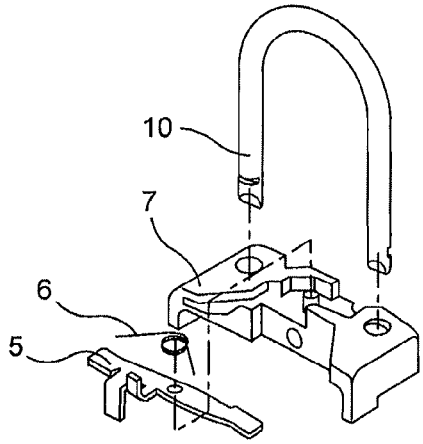
FIG. 5 is an exploded perspective view of the shackle; the shackle locking lever; and a shackle holder.
Figure 6:
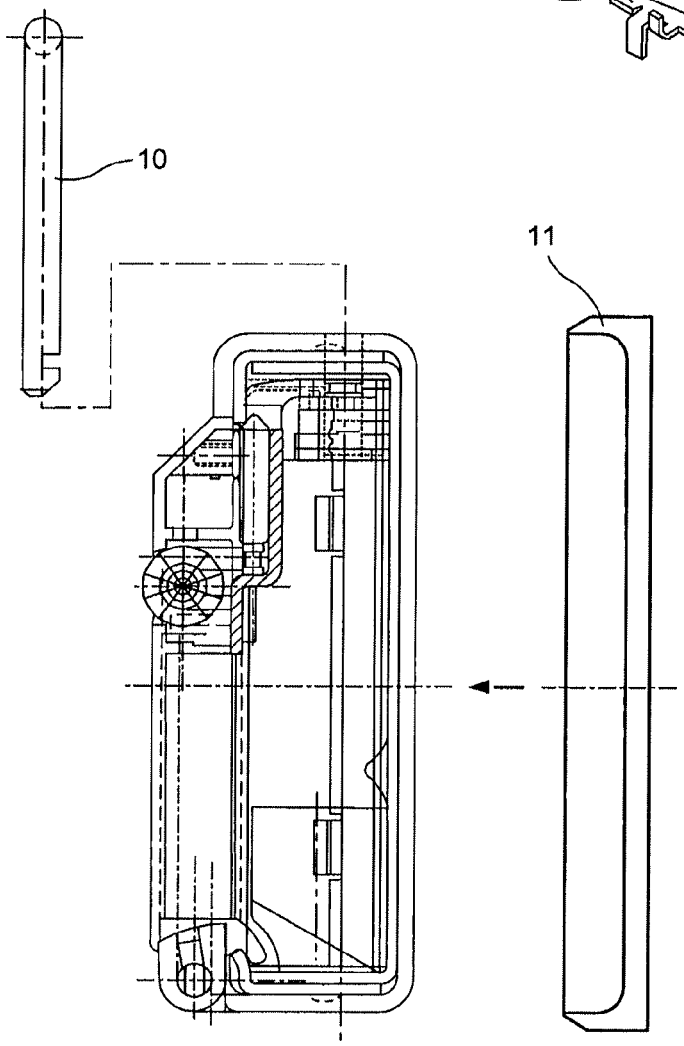
FIG. 6 is a view showing a process of detaching the shackle and attaching a rubber.

A shackle 10 (shown in FIGS. 4 and 5) in the form of an inverted "U" having a pair of leas symmetric about the apex of the "U" is constructed to be capable of being attached and detached in one-hand control that is, a single action permits the shackle to engage or disengage the lever 5. This facilitates the mounting of the key box on the wall, the door or the like. In addition, the basic parts (the door 1, the front outer cover 2, the front inner case 3, a key storing tray 4, a rear inner case 8, and a rear cover 9) can be made to serve a double purpose. Furthermore, since the shackle 10 is constructed in such a manner that both legs of the shackle 10 are locked by means of a shackle locking lever 5, a strength higher than that in the past can be secured (FIGS. 4 and 5). FIG. 6 shows that the shackle 10 for attaching to the wall, the door of a building or the like is being detached from the key box, and a rubber 11 is being attached.

Figures 1, 7:
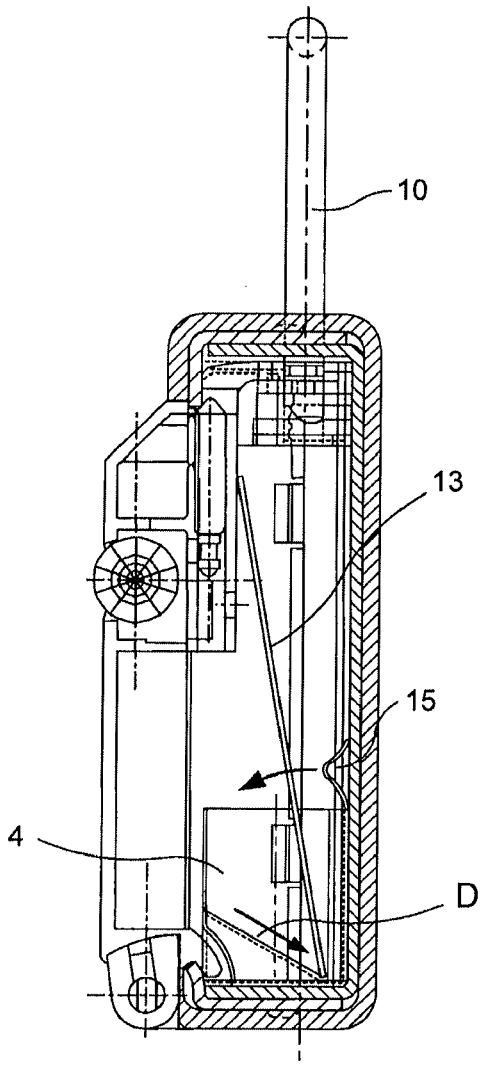
Figures 3, 7:
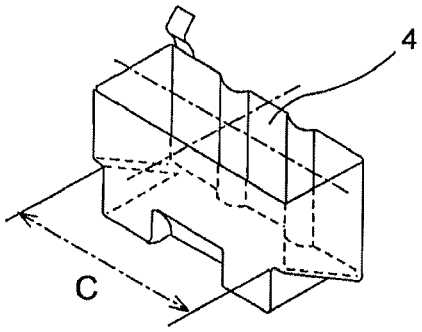
Figures 2, 7:
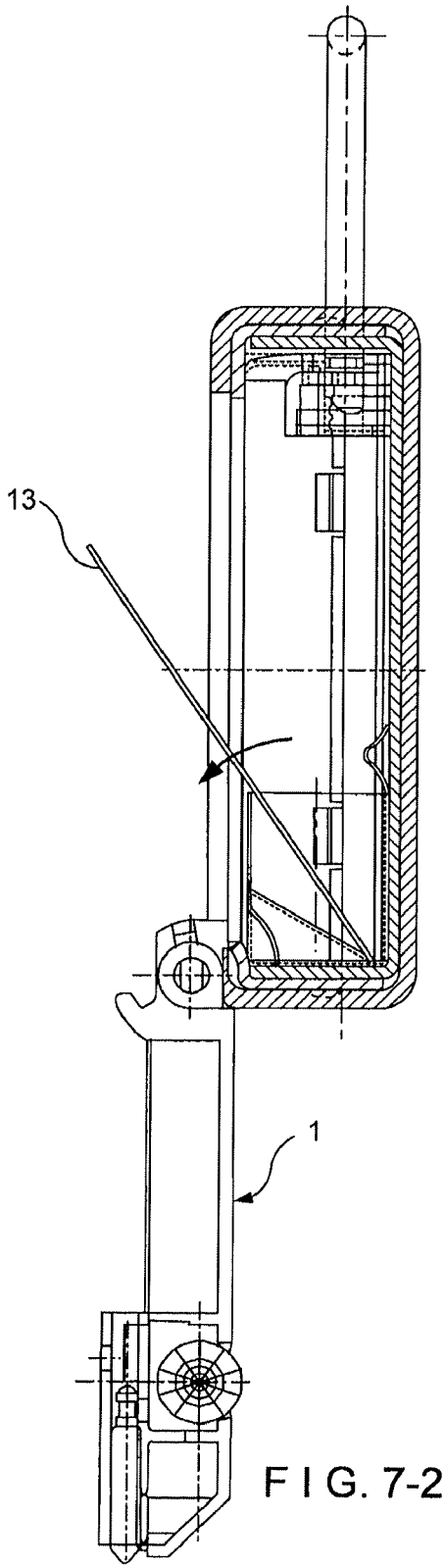

A key storing tray 4 is filled in the key box, and the bottom of the tray 4 is inclined (D) from the door side to the interior, and the interior wall of the tray is provided with a projection 15, whereby when a card 13 is inserted therein, it naturally falls to the side of the door towards the operator, thereby allowing the card to be easily taken out (FIGS. 7-1, and FIGS. 7-2). The inclination D is provided at both sides thereof with a width C a little narrower than the traversal width of the card 13, thereby minimizing the influence on the storing space of a key or the like.

The outer covers 2 and 9 are shaped in such a manner as to be assembled in a single operation, and flexible resin having color variation is used as a material. The front outer cover 2 is shaped in such a manner that when the door 1 is closed, removal is impossible due to the bearing parts 20 for rotating (opening) the door 1. The rear outer cover 9 is shaped in such a manner that because of the provision of holes 22 for inserting the shackle 10, removal thereof is impossible without detaching the shackle 10.

Figures 2, 8:
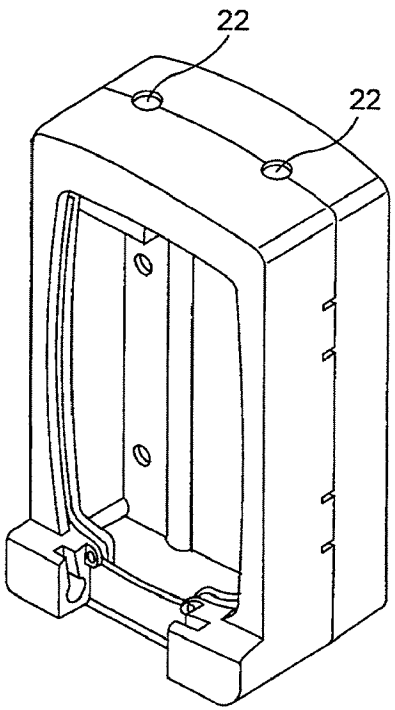
Figures 1, 8:
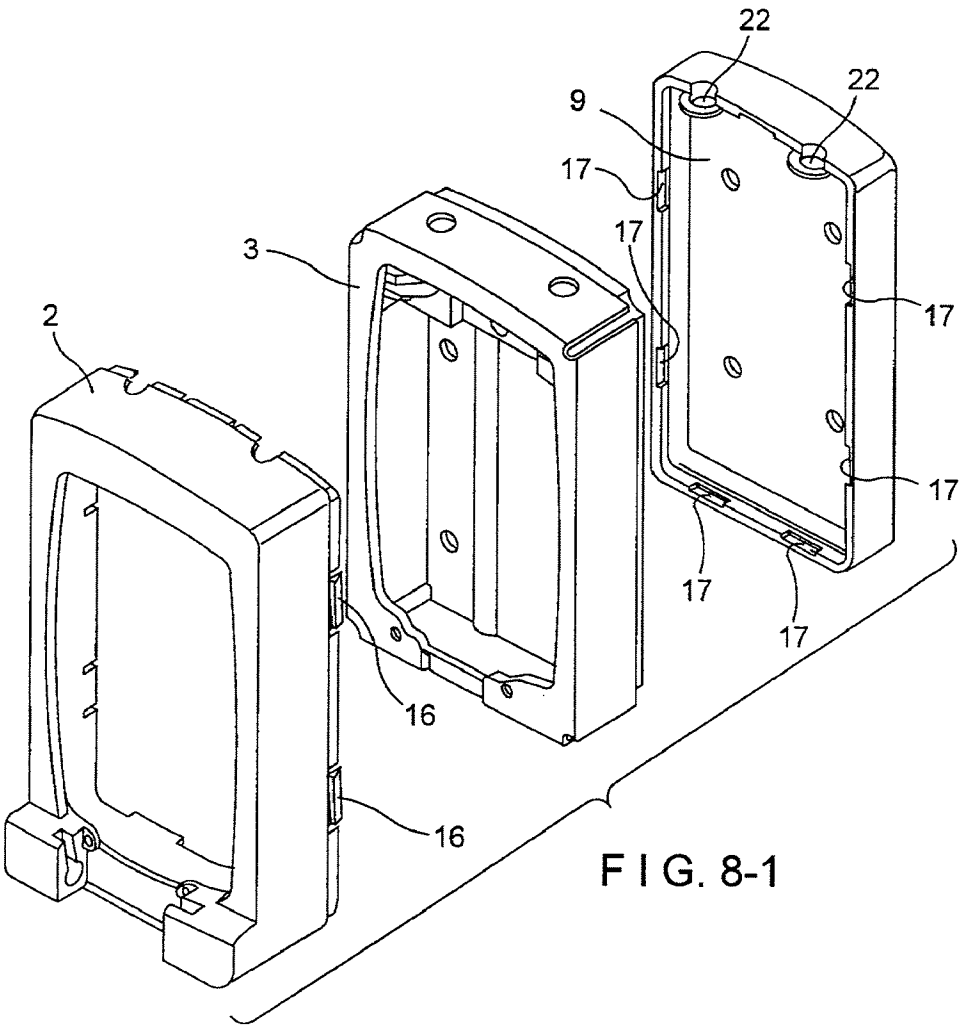
Figures 3, 8:
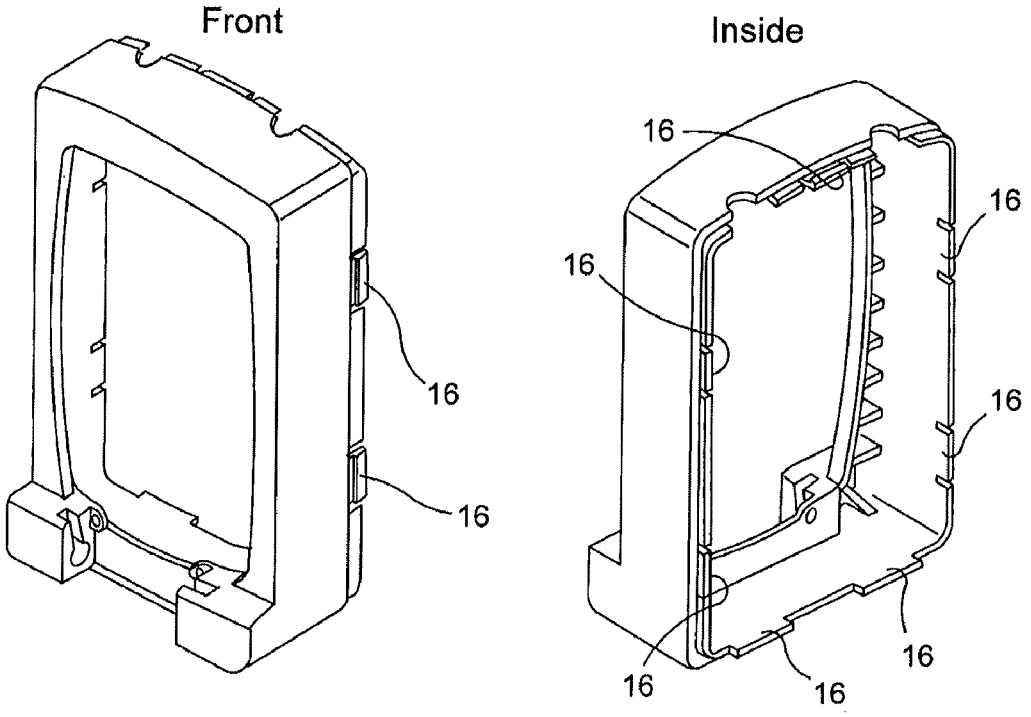

FIG. 8-1 shows a state before fitting the outer covers 2 and 9 to an inner case assembly (which consists of the front inner case 3, the shackle locking lever 5, the shackle locking lever spring 6, the shackle holder 7, and a rear inner case 8 (FIG. 10)). When assembling, pawls 16 at seven places of the front outer cover 2 are fitted into hook grooves 17 at seven places of the rear outer cover 9, respectively, in such a way that both outer covers 2 and 9 cover the inner case assembly.

FIG. 8-2 shows a state where the outer covers 2 and 9 are fitted to the inner case assembly. FIG. 8-3 comprises perspective views of the front outer cover 2, one being a view showing the front and the other being a view showing the inside, and the pawls 16 at seven places of the front outer cover 2 are clearly disclosed.

Figure 9:
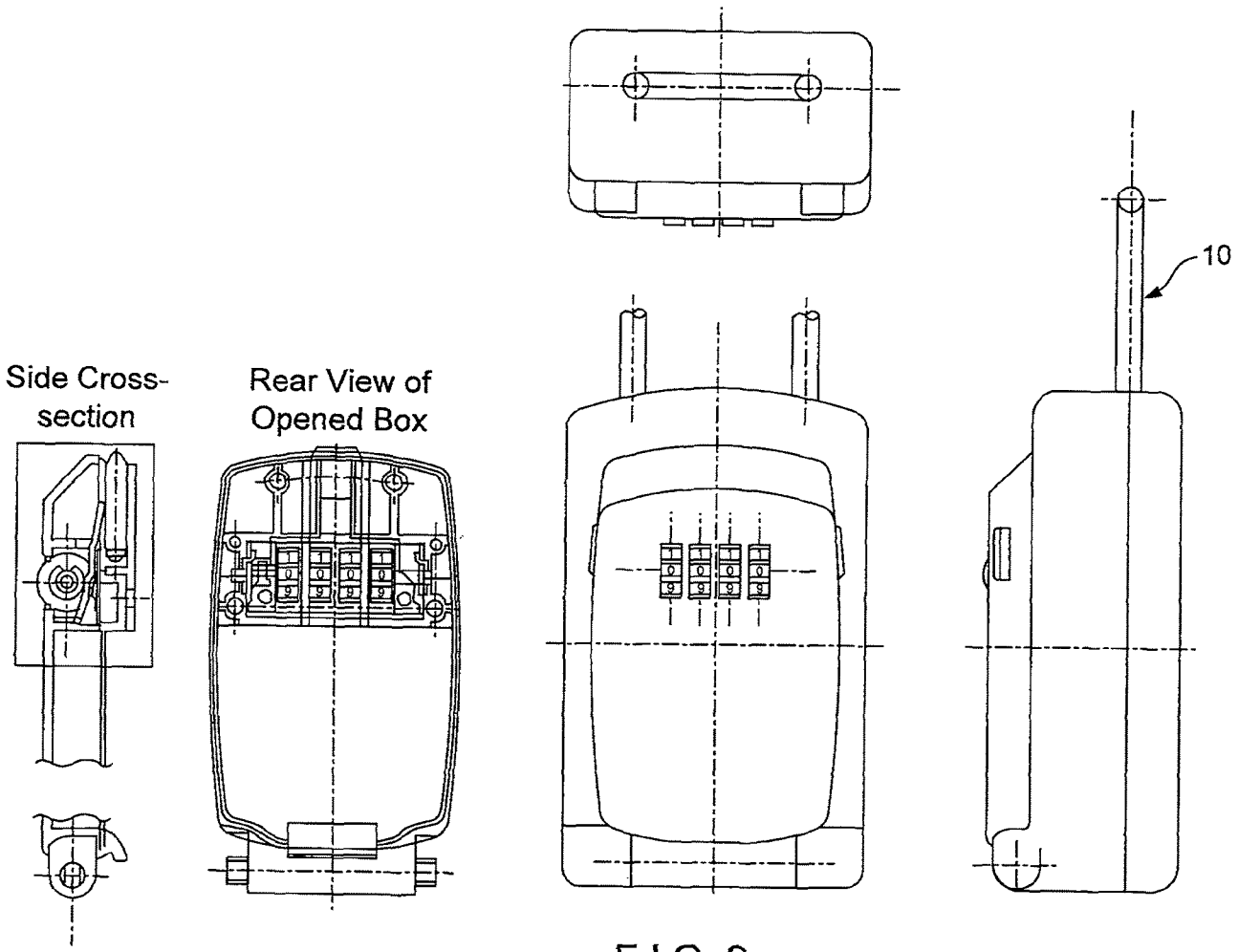
FIG. 9 comprises views each showing the side section of the door; the opened-up view showing the back; the front; the plan; and the side of the door.
Figures 1, 9:
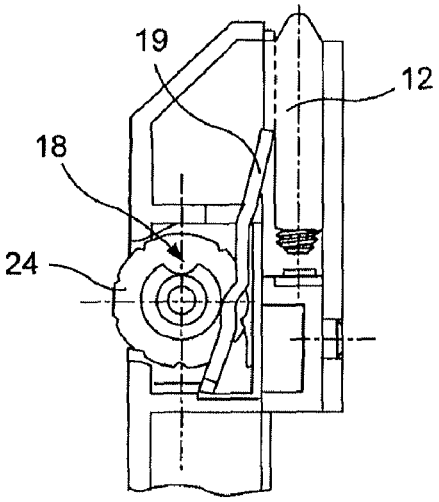
Figures 2, 9:
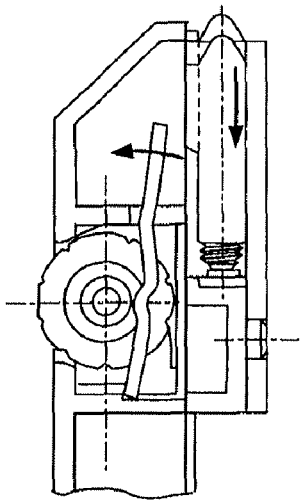

In the operation, when the dials 24 are rotated to show a secret code number, a locking plate 19 enters cam grooves 18 of cams 23 provided on the dials 24, as shown in FIG. 9-1 to FIG. 9-2, so that the latch 12 is released from the locking plate 19, and turns into a position allowing the latch 12 to descend, and accordingly, the door 1 can be opened.

The operation of the dials 24 and the locking plate 19 will be explained in detail. FIG. 9-3 shows four dials 24, and a position where the locking plate 19 enters the cam grooves 18 at the time of the figures of the dials 24 showing 0, and turns into a setting of opening the door. In FIG. 9-4 showing a state where any of the dials is set to the figure of 1, the locking plate 19 disengages from the cam grooves 18, so that a state of opening the door is not brought about. Furthermore, in FIG. 9-5 showing a state where any of the dials is set to the figure of 9, similarly to FIG. 9-4, the locking plate 19 disengages from the cam grooves 18, and a state of opening the door is not brought about.

Figure 10:
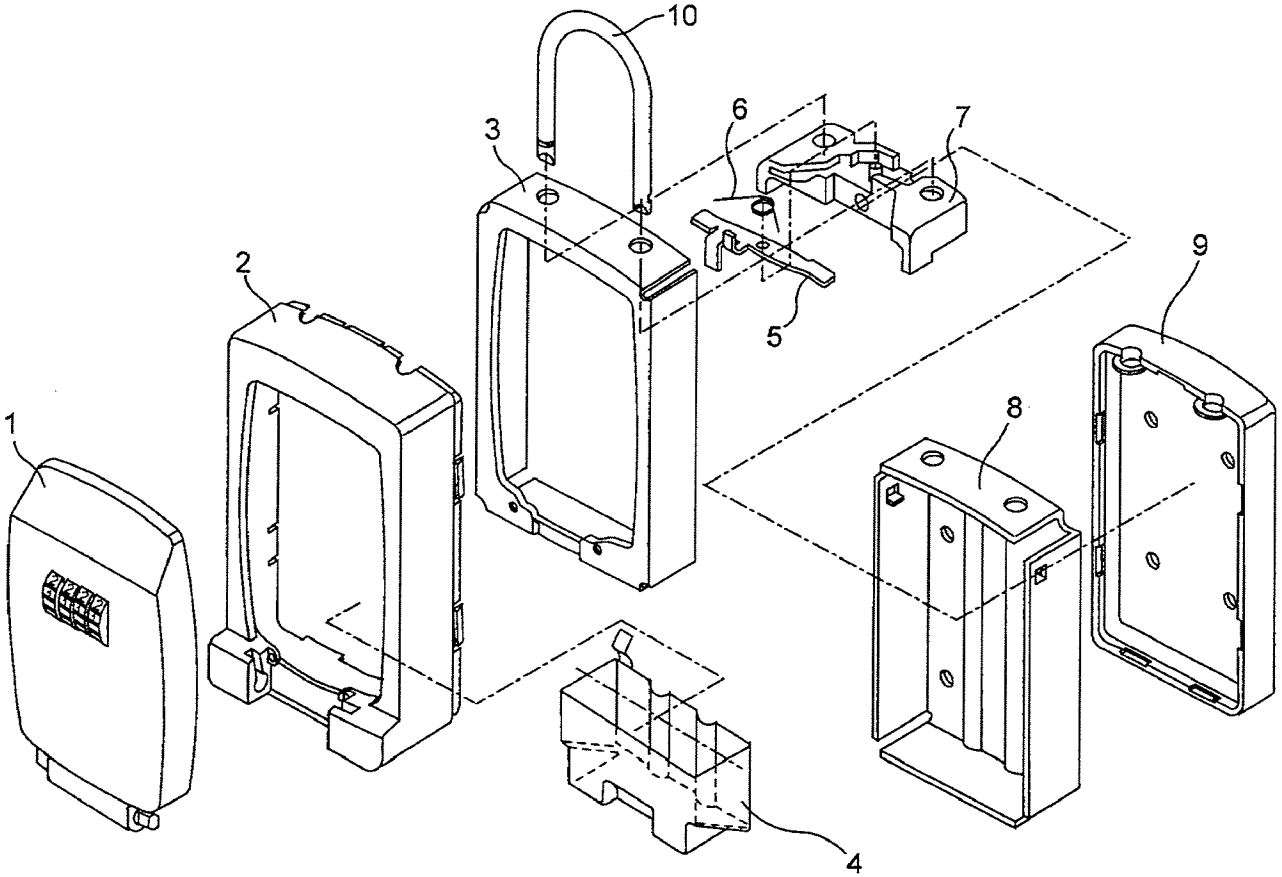
FIG. 10 is an exploded perspective view of a shackle type key box.

FIG. 10 shows an exploded perspective view of a shackle type key box, in which the door 1, the front outer cover 2, the front inner case 3, the key storing tray 4, the shackle locking lever 5, the shackle locking lever spring 6, the shackle holder 7, the rear inner case 8, the rear outer cover 9, and the shackle 10 are disclosed in a disassembled state.

Figure 11:
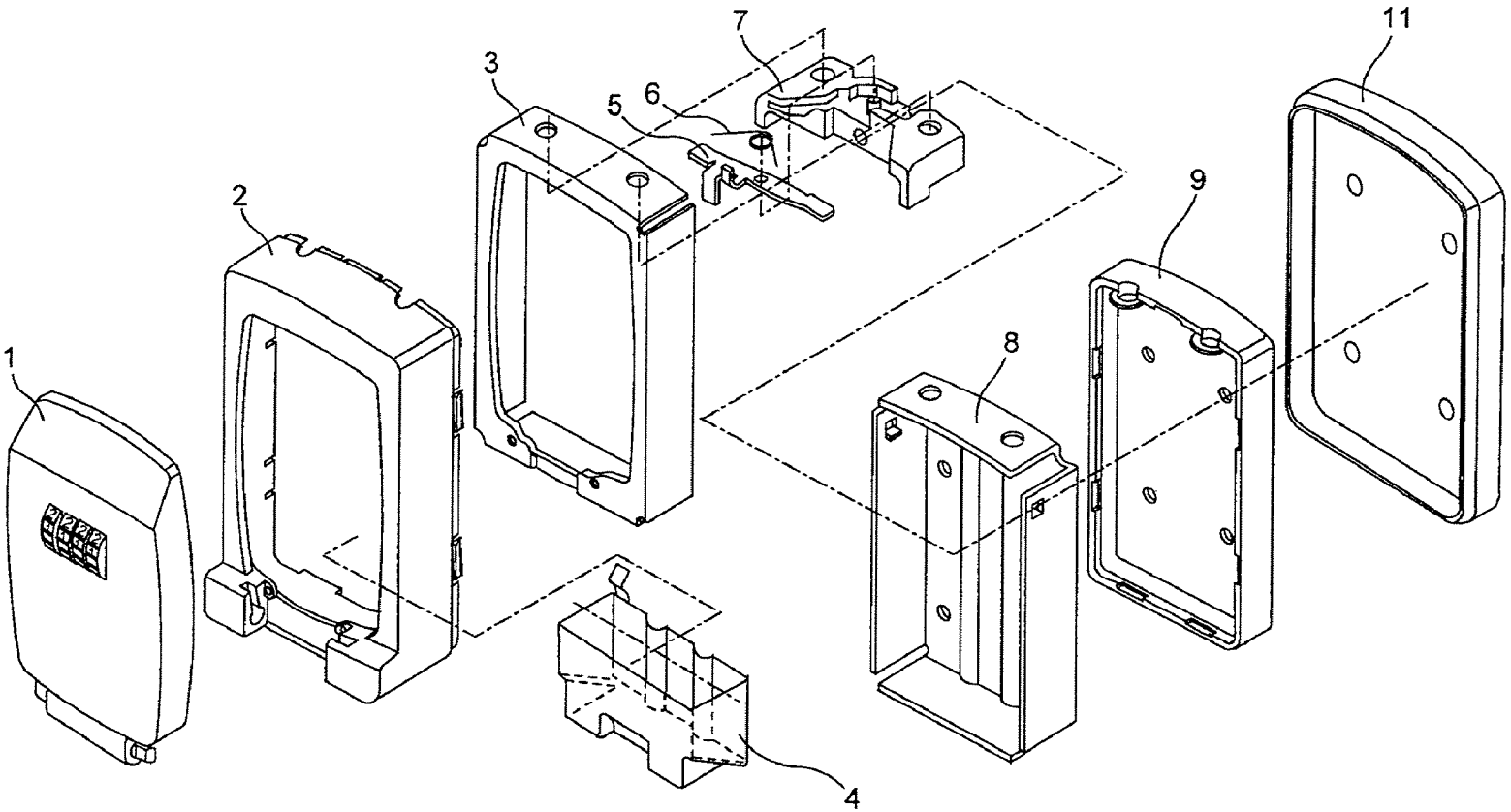
FIG. 11 is an exploded perspective view of a wall-mounted type; and a door-mounted type key box.

FIG. 11 shows an exploded perspective view of a wall-mounted type and a door-mounted type key box, which differs from a shackle type key box in that it does not comprise the shackle 10, but comprises the rubber 11, and uses the members 1-9 in common.

Figure 12:
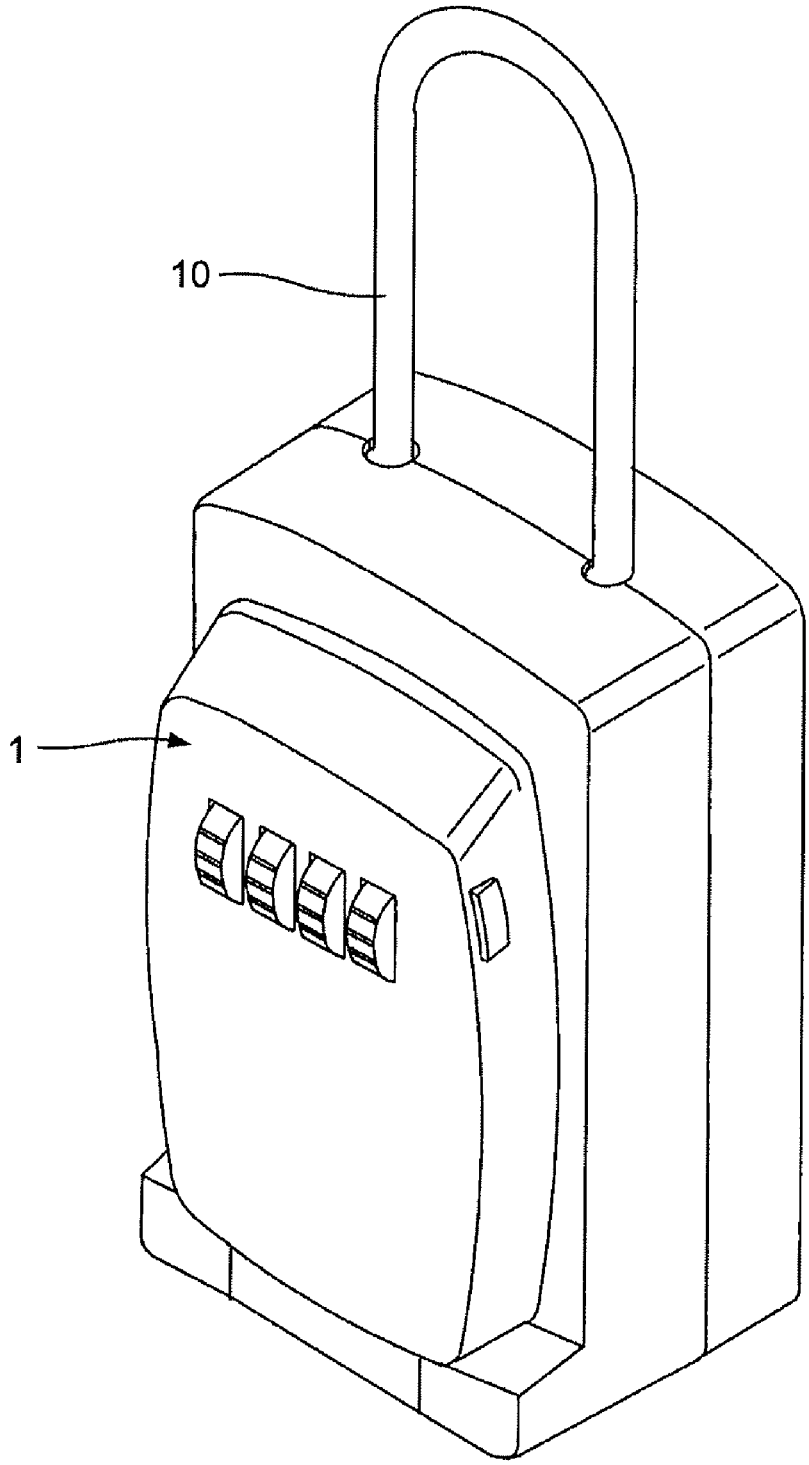
FIG. 12 is a perspective view of an external appearance of the key box.

As described above, the key box is explained in a disassembled state; however, FIG. 12 shows, in a perspective view, the external appearance of the key box assembled with these members.

EXPLANATION OF REFERENCE NUMERALS

1 Door
2 Front outer cover
3 Front inner case
4 Storing tray
5 Shackle locking lever
6 Shackle locking lever spring
7 Shackle holder
8 Rear inner case
9 Rear outer cover
10 Shackle
11 Rubber
12 Latch
13 Card
14 Hooks
15 Projection
16 Pawls
17 Hook groove
18 Cam grooves
19 Locking plate
20 Bearing parts of the outer cover
21 Shafts of the door
22 Holes
23 Cams
24 Dials

We claim:

1. A key box construction, characterized in that:

a rotary shaft of a door is provided with two parallel flat surfaces in axial extensions of the shaft at both ends thereof;

an outer cover is provided with bearing parts which each comprise a groove having a width equal to the distance between the flat surfaces and at a predetermined angle which allows the axial extensions to be removed from the grooves when the door is positioned at an angle equal to the predetermined angle;

the door is provided at a lower end portion thereof with hooks;

a "U" shaped shackle having a pair of legs symmetrical about the apex of the "U", each of said legs having a groove therein; and an inner case having a locking lever configured to engage the "U" shaped shackle;

whereby the door is hooked directly on the inner case by the hooks and a latch.

2. A key box construction claimed in claim 1 characterized in that:

a key storing tray is included in the key box construction, said key storing tray being inclined from the door side of the key box construction toward an interior of the key box construction whereby when a card, a key, a finger ring or the like is inserted therein, it falls to a side of the key box construction where the door is positioned.

3. A key box construction claimed in claim 1, characterized in that:

the outer cover further comprises a front outer cover and a rear outer cover;

the front outer cover is shaped in such a manner that when the door is closed, removal of the front outer cover is prevented due to the bearing parts for rotating the door; and the rear outer cover is shaped in such a manner that it is provided with holes for inserting the shackle, so that removal of the rear outer cover is prevented without detaching the shackle.

4. A key box construction claimed in claim 2, characterized in that:

the outer cover further comprises a front outer cover and a rear outer cover;

the front outer cover is shaped in such a manner that when the door is closed, removal of the front outer cover is prevented due to the bearing parts for rotating the door; and the rear outer cover is shaped in such a manner that it is provided with holes for inserting the shackle, so that removal of the rear outer cover is prevented without detaching the shackle.

5. A key box construction claimed in claim 1, characterized in that:

a key storing tray is included in the key box construction.

6. A key box construction claimed in claim 5, characterized in that:

the outer cover further comprises a front outer cover and a rear outer cover;

the front outer cover is shaped in such a manner that when the door is closed, removal of the front outer cover is prevented due to the bearing parts for rotating the door; and the rear outer cover is shaped in such a manner that it is provided with holes for inserting the shackle, so that removal of the rear outer cover is prevented without detaching the shackle.

7. A key box construction, characterized in that:

a rotary shaft of a door is provided with two parallel flat surfaces in axial extensions of the shaft at both ends thereof;

an outer cover provided with bearing parts which each comprise a groove having a width equal to the distance between the flat surfaces and at a predetermined angle which allows the axial extensions to be removed from the grooves when the door is positioned at an angle equal to the predetermined angle;

a "U" shaped shackle having a pair of legs symmetrical about the apex of the "U", each of said legs having a groove therein;

a key storing tray is included in the key box construction, said key storing tray being inclined from the door in an interior of the key box construction whereby when a card, a key, a finger ring or the like is inserted therein, it falls to a side of the key box construction where the door is positioned.

8. A key box construction claimed in claim 7, characterized in that:

the outer cover further comprises a front outer cover and a rear outer cover;

the front outer cover is shaped in such a manner that when the door is closed, removal of the front outer cover is prevented due to the bearing parts for rotating the door; and the rear outer cover is shaped in such a manner that it is provided with holes for inserting the shackle, so that removal of the rear outer cover is prevented without detaching the shackle.

* * * * *